343-756 SR
4/12/88 XR 4,737,741

United States Patent [19]

Wong

[11] Patent Number: 4,737,741

[45] Date of Patent: Apr. 12, 1988

[54] ORTHOGONAL MODE ELECTROMAGNETIC WAVE LAUNCHER

[75] Inventor: Mon N. Wong, Torrance, Calif.

[73] Assignee: Hughes Aircraft Company, Los Angeles, Calif.

[21] Appl. No.: 920,645

[22] Filed: Oct. 20, 1986

[51] Int. Cl.[4] ..... H01P 1/161; H01P 5/16

[52] U.S. Cl. ..... 333/126; 333/137; 333/248; 333/21 A; 343/756

[58] Field of Search ..... 333/21 A, 125, 126, 333/135, 137, 239, 248; 343/756

[56] References Cited

U.S. PATENT DOCUMENTS

| | | | |
|---|---|---|---|
| 2,979,679 | 4/1961 | Ellis | 333/21 A X |
| 3,284,725 | 11/1966 | Bowman | 333/125 |
| 3,566,309 | 2/1971 | Ajioka | 333/135 |
| 4,622,524 | 11/1986 | Morz | 333/126 |

*Primary Examiner*—Paul Gensler

*Attorney, Agent, or Firm*—S. M. Mitchell; M. J. Meltzer; A. W. Karambelas

[57] ABSTRACT

A launcher of cross-polarized electromagnetic radiation is provided with increased bandwidth by inserting a set of axially directed ridges on the interior surfaces of waveguide walls of the launcher for concentrating electric fields of radiations of the different polarizations. A first radiation radiated by a probe in a back section of the launcher waveguide propagates forward into a front section of the launcher waveguide. A second radiation is radiated into the front section by a probe therein, there being a vane disposed in the front section for inhibiting the propagation of the second radiation into the back section. The front section is flared to provide a larger exit aperture at a front end of the front section. A second and a fourth of the ridges are tapered towards the back section to permit a smooth transition in the propagation of the first radiation into the front section.

24 Claims, 4 Drawing Sheets

ORTHOGONAL MODE ELECTROMAGNETIC WAVE LAUNCHER

BACKGROUND OF THE INVENTION

This invention relates to microwave structures for the transmission of electromagnetic waves in different modes of propagation and, more particularly, to a structure enabling the coupling of waves at differing polarizations into a wide bandwidth transmission link.

Various types of microwave systems employ the transmission of microwave signals having different polarizations in a common waveguide. By way of example, a radar system may employ a horn fed by a waveguide carrying cross-polarized electromagnetic waves for driving the horn in two orthogonal modes. A structure which has been used for combining the electromagnetic waves is the orthogonal mode tee having both an E-plane bend and an H-plane bend whereby waves having cross polarization can be launched in a single waveguide structure.

A problem arises in that presently available microwave structures are excessively limited in bandwidth so that, as a practical matter, only two signals can be transmitted in the orthogonal mode configuration. The use of plural frequencies in each mode of transmission has not been attainable due to the limited bandwidth of microwave structures which couple signals of differing polarizations into a common waveguide transmission link. As a result, designers of microwave signal transmission systems, such as radar systems, are unduly limited in the number of microwave channels which can be carried in a single waveguide transmission link.

SUMMARY OF THE INVENTION

The foregoing problem is overcome and other advantages are provided by an orthogonal mode launcher of electromagnetic waves which, in accordance with the invention provides for the simultaneous and independent launching of cross-polarized electromagnetic waves within a square waveguide structure having a bandwidth approaching an octave. Such a frequency band has adequate width to allow for the propagation of signals at two different bands of frequencies at one polarization, and signals at two further bands of frequencies at the other polarization. In addition, since the signals generated at the two polarizations are completely independent of each other, the frequencies of signals at the two polarizations may be equal or unequal to each other. Thereby, the microwave structure of the invention for launching the foregoing microwave signals enables the launching of four separate microwave signals within a single waveguide. Also, the connection between the input ports and the launcher output are reciprocal in their operation so as to permit the transmission and reception of any of the foregoing signals.

The structure of the launcher of the invention is formed within a waveguide having a square or circular cross-section. One end of the square waveguide is open and is circumscribed by a flange for connection to a utilization device such as a horn. The opposite end of the waveguide is closed off by a wall, which acts as a short circuit to electromagnetic radiation propagating within the waveguide. One pair of opposed walls may be referred to as the top and the bottom walls, while the other pair of opposed walls may be referred to as the sidewalls. One input port, which may be referred into as the straight port, is placed in the top wall near the end wall, while the second input port, which may be referred to as the side port, is placed in a side wall adjacent the open end of the waveguide. Both of the ports are configured for receiving a coaxial cable, and include a probe formed as an extension of the center conductor of the port and extending to a longitudinal axis of the waveguide. The straight port excites an electromagnetic wave with an electric field parallel to the sidewalls while the side port excites an electromagnetic wave with an electric field parallel to the top and the bottom walls.

The launcher waveguide includes tuning structures for isolating the side port from the straight port. Two vanes are positioned, one behind the other, in a common plane with the probe of the side port midway between the top and the bottom walls for blocking any electric field of the side port from propagating to the straight port. Thus, radiation associated with the side port propagates outward through the open end of the launcher waveguide without coupling to the straight port located in the opposite direction from the side port. The pair of vanes is transparent to propagation of the radiation from the straight port and, therefore, allows radiation from the straight port to travel forward to exit from the open end of the waveguide.

A set of four ridges are placed within the launcher waveguide, each of the ridges being located along a central line of one of the waveguide walls, and extending from the waveguide wall towards a central longitudinal axis of the waveguide. Each of the ridges extends approximately one-third of the distance between opposed walls of the waveguide. The ridges increase the bandwidth of the frequency response of the launcher waveguide to the foregoing radiation. The ridges located in the top wall and the bottom wall extend for the full length of the launcher waveguide. The ridges located in the sidewall extend from the open end of the waveguide past the side port, and then taper down to zero height from their respective walls at a distance of at least one-fourth of the guide wavelength in front of the straight port. The rear shorting wall of the launcher waveguide is located at one-fourth of the guide wavelength behind the straight port. Each of the ridges has a width, as measured in a plane parallel to the end of the waveguide, of approximately one-fourth of a side of the open end of the waveguide.

The ridges on the sidewalls are essentially transparent to the radiation of the straight port. However, in view of the relatively large width, it is to be anticipated that the sidewall ridges are not completely transparent to the radiation of the straight port. The aforementioned taper in the shape of the sidewall ridges facilitates passage of the radiation from the straight port to exit from the open end of the guide. The foregoing arrangement of the waveguide components provides for the broadened bandwidth while retaining isolation between radiations of the straight port and the side port.

BRIEF DESCRIPTION OF THE DRAWING

The aforementioned aspects and other features of the invention are explained in the following description, taken in connection with the accompanying drawing wherein.

DETAILED DESCRIPTION

Figure 1:
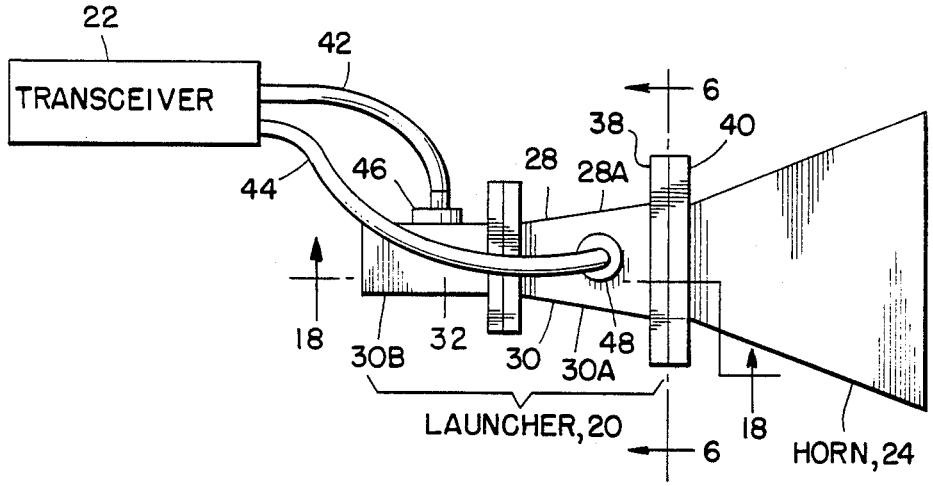
FIG. 1 shows a simplified view of an orthogonal mode launcher of the invention coupled to a transceiver and to a horn.
Figure 2:
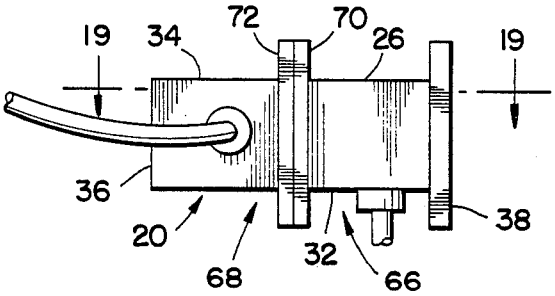
FIG. 2 is a top view of the launcher of FIG. 1.
Figure 3:
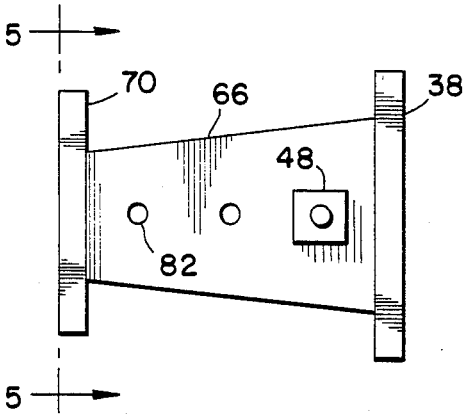
FIG. 3 is a side view of a front section of the launcher of FIG. 1.
Figure 4:
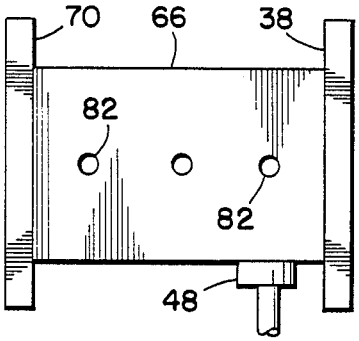
FIG. 4 is a top plan view of the front section of FIG. 3.
Figure 5:
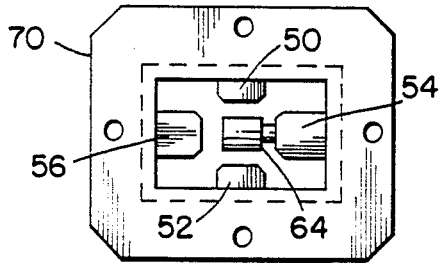
FIG. 5 is an end view of the front section of FIG. 3 taken along the line 5—5 in FIG. 3.
Figure 6:
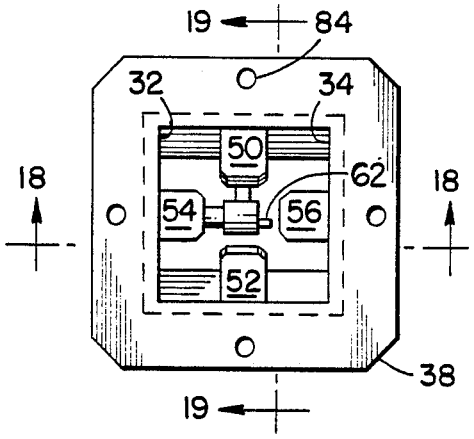
FIG. 6 is an end view of the launcher taken along the line 6—6 in FIG. 1, the connection of coaxial cables having seen deleted for simplicity.
Figure 7:
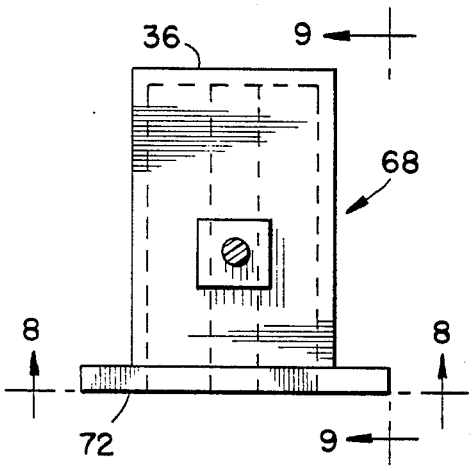
FIG. 7 is a top view of the back section of the launcher of FIG. 1.
Figure 9:
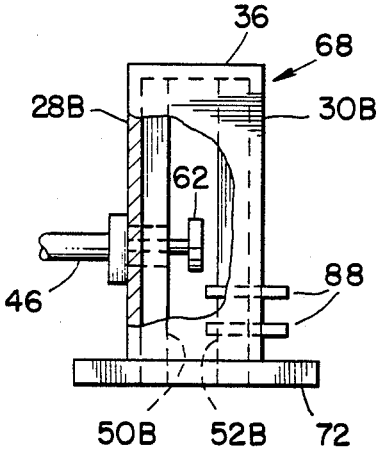
FIG. 9 is a side view, partially cut away, of the back section of FIG. 7 taken along the line 9—9 in FIG. 7.
Figure 8:
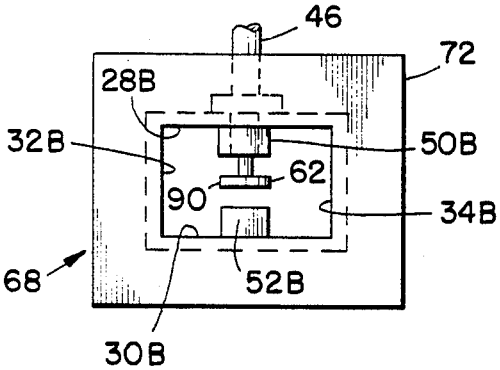
FIG. 8 is an end view of the back section of FIG. 7 taken along the line 8—8 in FIG. 7.
Figure 10:
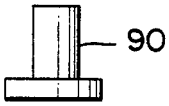
FIG. 10 is a side view of a radiating element of a port in a top wall of the launcher for connection with a coaxial cable.
Figure 11:
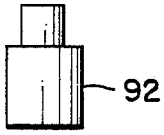
FIG. 11 shows a side view of a radiation element of a port in a sidewall of the launcher for connection with a coaxial cable.
Figure 12:
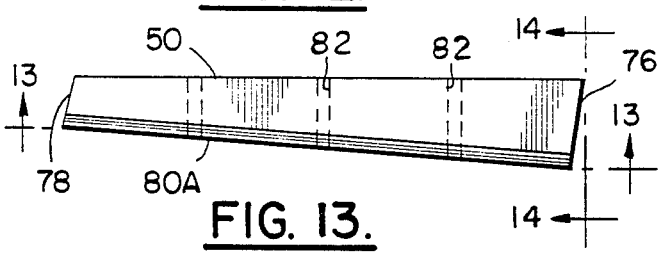
FIG. 12 is a side view of a ridge located within the front section of the launcher and secured to the top wall, a similar ridge being positioned on the bottom wall.
Figure 13:
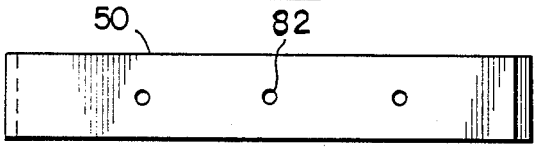
FIG. 13 is a bottom view looking up at the ridge of FIG. 12 taken along the line 13—13 in FIG. 12.
Figure 14:
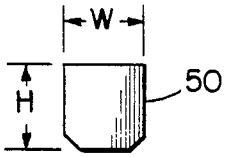
FIG. 14 is a front view of the ridge of FIG. 12 taken along the line 14—14 in FIG. 12.
Figure 17:
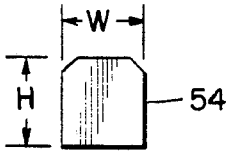
FIG. 17 is an end view of the ridge of FIG. 15 as viewed along the line 17—17 in FIG. 15.
Figure 15:
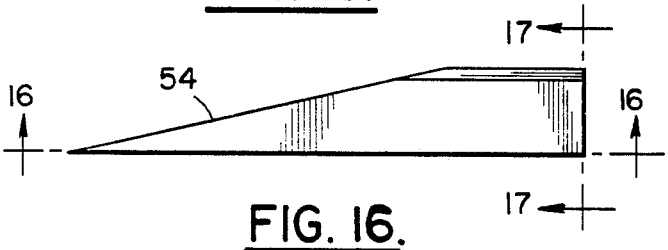
FIG. 15 is a top view of a ridge located in the front section of the launcher and secured to a sidewall thereof, a similar ridge being located on the other sidewall.
Figure 16:
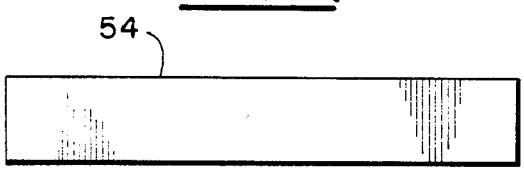
FIG. 16 is a side view looking at a side face of the ridge of FIG. 15 taken along the line 16—16 in FIG. 15.
Figure 18:
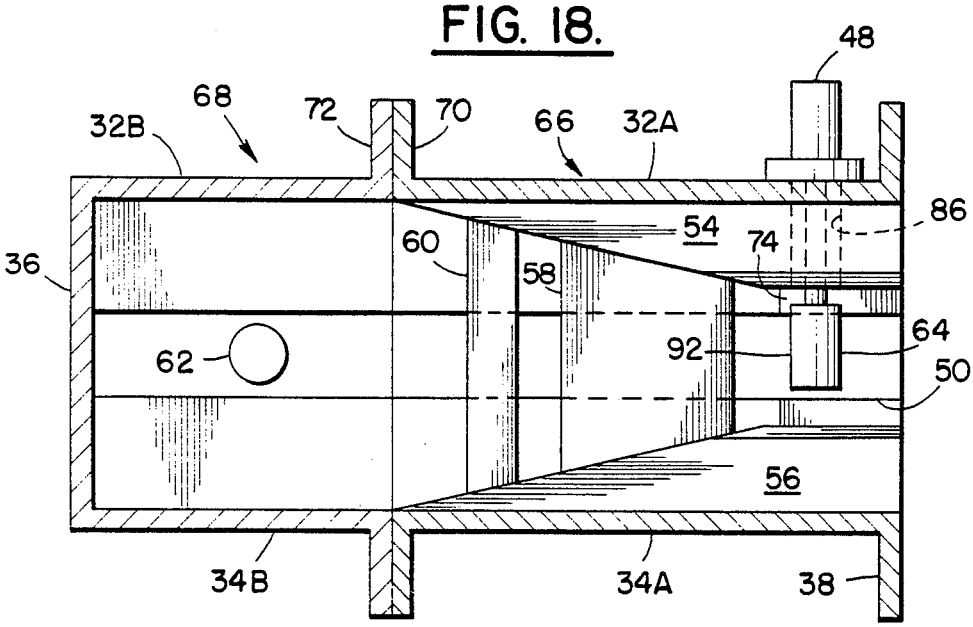
FIG. 18 is a sectional view looking of the launcher as viewed along the line 18—18 in FIG. 1, the location of the section being shown along line 18—18 in FIG. 6.
Figure 19:
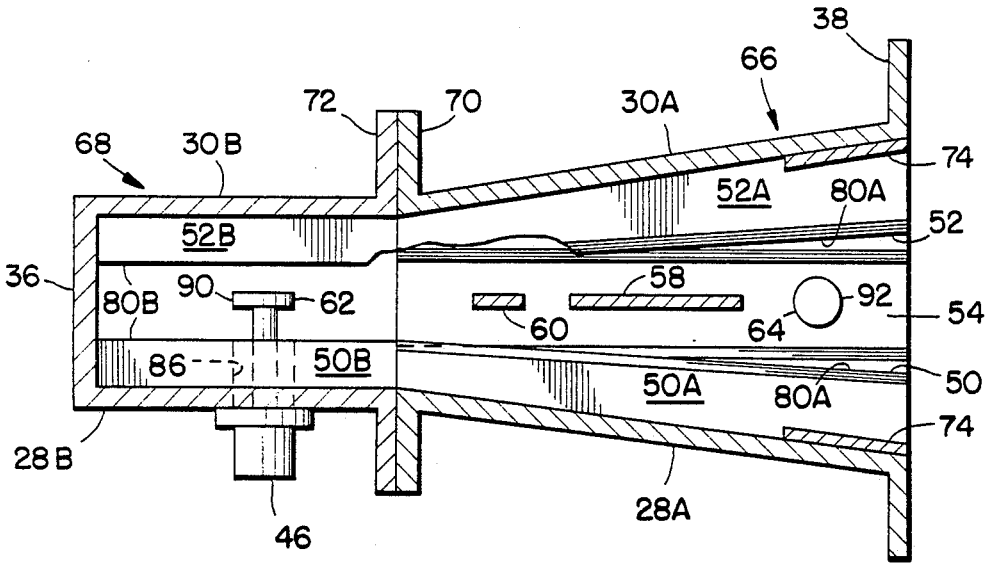
FIG. 19 is a sectional view of the launcher as viewed along the line 19—19 in FIG. 2, the location of the section being shown via line 19—19 in FIG. 6.

FIG. 1 shows an orthogonal mode launcher 20 constructed in accordance with the invention for launching an electromagnetic wave which is vertically polarized and an electromagnetic wave which is horizontally polarized. The figure shows one example in the use of the launcher 20, wherein the launcher 20 connects a transceiver 22 to a horn 24. By way of example, the transceiver 22 may generate signals which are to be radiated by the horn 24 to a distant site for reception of the signals. The launcher 20 is reciprocal in its operation enabling incoming signals received at the horn 24 to be coupled to the transceiver 22.

With reference also to FIGS. 2–19, the launcher 20 is constructed of a waveguide 26 having a rectangular cross-sectional configuration, the waveguide including a top wall 28 and a bottom wall 30 which are joined by sidewalls 32 and 34, certain ones of the walls of the waveguide being tapered. A back wall 36 closes off a back end of the waveguide 26. The front end of the waveguide 26 and of the launcher 20 is open for connection to the horn 24 or other utilization device. A front flange 38 extends outwardly from the waveguide 26 to mate with a flange 40 of the horn 24. Connection with the transceiver 22 is provided by coaxial cables 42 and 44. The cable 42 connects with a straight port 46 located on the top wall 28 for generation of the vertically polarized electromagnetic waves. The cable 44 connects with a side port 48 located on the sidewall 32 for generation of the horizontally polarized electromagnetic waves.

In accordance with the invention, within the waveguide 26, there are provided components of the launcher 20 which produce the desired broad bandwidth characteristic of the launcher, and also provide for isolation of the electromagnetic waves radiated by each of the ports 46 and 48 within the waveguide 26. Within the waveguide 26 there are located four ridges extending in the longitudinal direction, namely a ridge 50 on the top wall 28, a ridge 52 on the bottom wall 30, a ridge 54 on the sidewall 32, and a ridge 56 on the sidewall 34. Extending transversely across the waveguide 26 between the ridges 54 and 56 are two shorting vanes 58 and 60, the vane 58 being located in front of the vane 60 and coplanar therewith. The straight port 46 includes a probe 62 at the top wall 28, and the side port 48 includes a probe 64 at the sidewall 32. The probe 62 extends from the ridge 50 to a center line of the waveguide 26. The probe 64 extends from the ridge 54 to the center line of the waveguide 26.

The waveguide 26 is provided with a one-dimensional flare produced by enlargement of the sidewall 32 and 34 in the forward portion of the waveguide 26 as compared to a sidewall dimension at the rear portion of the waveguide 26. The flared structure is readily fabricated by constructing the waveguide 26 of two sections, namely, a front section 66, and a back section 68 which are joined together by flanges 70 and 72 secured respectively to the front and the back sections 66 and 68. If desired, the waveguide 26 can be fabricated either from a single forging, or by dividing the waveguide 26 into the front section 66 and the back section 68; the latter structure is preferred in the preferred embodiment to facilitate emplacement of the foregoing elements within the waveguide 26. The portions of the waveguide walls comprising the front section 66 are identified by the suffix A as 28A–34A, and the portions of the walls comprising the back section 68 are identified by the suffix B as 28B–34B. High ordered mode shifters 74 having the form of shims may be placed on the top wall 28 and the bottom wall 30 at the front end of the waveguide 26 to attenuate any higher order modes of radiation propagation, so that only the primary modes initiated by the probes 62 and 64 exit the launcher 20.

The ridges 50 and 52 extend through the entire length of the top and the bottom walls 28 and 30. The ridges 54 and 56 extend only within the front section 66. Both of the ridges 50 and 52 have the same shape, and both of the ridges 54 and 56 have the same shape. The ridge 50 is formed in two sections 50A and 50B which sit, respectively, in the front and the back sections 66 and 68. Similarly, the ridge 52 is formed of two sections 52A and 52B which sit within the front and the back sections 66 and 68.

The ridges 50 and 52 are tapered from front to back to compensate for the flaring of the sidewalls 32A and 34A. Also, the front and back edges 76 and 78 of the ridge 50A are angled to compensate for the flaring of the sidewalls 32A and 34A. By this compensation, the front and the back edges 76 and 78 lie within transverse planes of the waveguide 26. The foregoing constructional features of the ridge 50A apply also to the ridge 52A. By this compensation, the inner edges 80A of the ridges 50A and 52A are angled slightly with the inner edges 80B of ridges 50B and 52B for a smaller flare than the flare of the waveguide 26. The ridges 50, 52, 54, and 56 are provided with apertures 82 for receiving screws (not shown) whereby the ridges are secured to the corresponding wall of the waveguide 26. Apertures 84 in the flange 38, as well as in the other flanges permit the joining of the flanges by use of bolts (not shown). Further apertures 86 are placed in the ridges 50 and 54, and their corresponding walls 28 and 32 for affixation of the ports 46 and 48. Tuning screws 88 may be placed in the ridge 52B for tuning radiation emanating from the straight port 46.

With respect to the dimensions of the various components of the launcher 20, in terms of the wavelength of the midband frequency of radiation, these dimensions have been selected to provide for the broadband operation and for the independent generation of the orthogonal polarization modes of the radiation. The aperture of the waveguide 26 at the front flange 38 has a square shape with a side measuring $\frac{2}{3}$ free-space wavelength. The aperture of the rear of the front section 66, at the flange 70, is reduced in the sidewall dimension, only, to provide a rectangular cross-section wherein the sidewall dimension is $\frac{1}{3}$ wavelength while the top wall dimension is retained at $\frac{2}{3}$ wavelength. The axial length of the front section 66 is 1.6 wavelength. Opposed walls of the front section 66 are symmetrically positioned about a central line of the waveguide 26. The width W of each of the ridges 50, 52, 54, and 56 is equal to $\frac{1}{4}$ of the edge of the waveguide opening at the front flange 38, this being equal to 1/6 wavelength. The ridges 50, 52, 54, and 56 extend from their respective walls toward the center line on the waveguide 26 a distance of 1/5 wavelength at the front flange 38. The extension H of the ridges 50 and 52 from their respective walls towards the center line is reduced in the back section 68 to 0.1 wavelength. The foregoing wavelength measurements are in terms of the free space wavelength. The straight probe 62 is positioned midway between the back wall 36 and the junction of the flanges 70 and 72, the spacing of the straight probe 62 being $\frac{1}{4}$ guide wavelength from the back wall.

In operation, the ridges 50 and 52 enlarge the bandwidth of a vertically-polarized electromagnetic signal radiated by the top-wall probe 62 into the waveguide 26. The ridges 50 and 52 are substantially transparent, though not completely transparent, to horizontally-polarized electromagnetic signals radiated by the sidewall probe 64 into the waveguide 26. The ridges 54 and 56 broaden the bandwidth of the signals radiated by the sidewall probe 64. The ridges 54 and 56 are substantially transparent, though not completely transparent, to the vertically-polarized radiation of the top-wall probe 62.

An interesting feature of the configuration of the four ridges 50, 52, 54, and 56 is the fact that the opposed ridges 50 and 52 tend to concentrate the electric field of the top-wall probe 62 to the region between the ridges 50 and 52, while reducing the presence of the electric field at other portions of the waveguide 26, such as in the regions of the four corners between the adjacent pairs of ridges, namely, 50 and 56, 56 and 52, 52 and 54, and 54 and 50. A similar effect is provided by the opposed ridges 54 and 56 to the radiation of the sidewall probe 64. As a result of this concentration, an important advantage of the invention is attained in that the ridges 50 and 52 need not be completely transparent to the horizontally polarized radiation, and that the ridges 54 and 56 need not be completely transparent to the vertically-polarized radiation, because the major portion of the energies of the respective radiations are not found near the walls of the waveguide 26, but, rather, are concentrated along the central region of the waveguide 26 between the ridges 50, 52, 54, and 56.

A further feature of interest in the operation of the launcher 20 is the fact that the ridges 50, 52, 54, and 56 tend to alter the paths of propagation of electromagnetic waves, and their angles of reflection from the waveguide walls, as well as from the ridges, within the waveguide 26 resulting in a reduction in the guide wavelength. This is significant with respect to the placement of the vane 58 behind the sidewall probe 64, and the placement of the backwall 36 behind the top-wall probe 62. All of the walls of the waveguide 26, as well as the ridges and the vanes are fabricated of a metal such as brass or silver coated aluminum so as to be electrically conductive. The back wall 36 provides a short circuit to radiation incident thereupon and reflects such radiation forward. Similarly, the vane 58 serves as a short circuit to horizontally polarized radiation of the probe 64, and reflects such radiation forward. Both the back wall 36 and the leading edge of the front vane 58 are positioned one-quarter of the guide wavelength of their respective radiations behind their respective probes 62 and 64 so that the short circuit appears as an open circuit at the sites of the respective probes 62 and 64. However, the actual physical spacing between the back wall 36 and its probe 62, and the vane 58 and its probe 64 differ because of the differences in the guide wavelengths introduced by the ridges as noted hereinabove. As shown in the figures, the spacing between the vane 58 and its probe 64 is smaller than the spacing between the back wall 36 and its probe 62.

The length of the front vane 58, as measured along the longitudinal axis of the waveguide 26, is approximately one-half of the free-space wavelength. The spacing between the front vane 58 and the rear vane 60 is approximately one-third the length of the front vane 58. The length of the rear vane 60, as measured along the longitudinal axis of the waveguide 26, is approximately one-fourth of the free-space wavelength. These dimensions are given in terms of the free-space wavelength because the guide wavelength differs at different parts of the waveguide 26 due to the presence of the four ridges in the front section 66 while only two ridges are present in the back sections 68. The two vanes 58 and 60 are employed in lieu of a single vane, the two vanes being separated by a sufficient amount to allow for independent operation of the two vanes so as to ensure more completely that none of the horizontally-polarized radiation of the sidewall probe 64 radiates back into the back section 68. In terms of the operation of the vanes 58 and 60, the spacing or gap between the two vanes 58 and 60 inhibits the formation of any circulating currents which might tend to be induced within the vanes by a transverse electric wave radiated from the sidewall probe 64.

As noted above, the ridges 54 and 56 are substantially transparent to the vertically-polarized radiation of the top-wall probe 62. In order to ensure a smooth transition in the propagation of the electromagnetic wave from the top-wall probe 62 into and through the front section 66 without any significant reflections from the ridges 54 and 56, the portions of the ridges 54 and 56 extending towards the back section 68 are tapered. This minimizes any reflections, reduces the standing wave ratio, and ensures optimum bandwidth for the simultaneous propagation of both the horizontally and the vertically-polarized electromagnetic waves. The cross polarization ensures independent propagation of the radiations at the two polarizations with essentially no interaction therebetween.

The broadened bandwidth permits two frequency bands of radiation to be transmitted at each of the two polarizations. By way of example, two such bands employed in the preferred embodiment of the invention are 3.7–4.2 GHz and 5.9–6.425 GHz. There is a band gap of 4.2–5.9 GHz which separates the two frequency bands so as to permit signals to propagate separately in the two bands without interaction. This provides for a total of four separate signals which can be carried by the launcher 20. In the event that narrow band signals are employed, such as signals having a sinusoidal phase modulation rather than a digital, square-wave phase modulation, then the bandwidth of the launcher 20 is sufficiently broad to carry still more frequency bands at each of the two polarizations. For example, such bands might have a width of 0.2 GHz and be separated by 0.6 GHz. This would give rise to bands of the following frequencies, 3.7–3.9 GHZ, 4.5–4.7 GHz , 5.3–5.5 GHz, and 6.1–6.3 GHz at each of the polarizations. This would provide a total of eight independent communication channels which can be handled by the launcher 20. It is understood that the transceiver 22 would have, in such case, four separate channels for processing the signals at one of the polarizations and additional four separate channels for processing the signals at the other polarization.

In the construction of the straight port 46, the probe 62 is terminated with a disk-shaped element 90 which enhances radiation from the probe into the waveguide 26. In the preferred embodiment of the invention, the element 90 is formed as a disk mounted on a stem, the stem having a diameter of 0.16 inch. The overall length of the element 90 is 0.4 inch corresponding approximately to 0.17 wavelength (free space). The diameter of the disk is 0.25 inch corresponding to approximately 0.1 wavelength. The element 90 permits radiation up to frequencies as high as 8 GHz. In the construction of the side port 48, the probe 64 is terminated in an element 92 which is in the form of a cylinder mounted on a stem wherein the diameter of the stem is 0.16 inches, the length of the stem is 0.1 inch, and the length of the cylindrical portion is 0.3 inch. The total length of the cylinder plus the stem is equal to approximately 0.17 wavelength. The diameter of the cylinder is 0.125 inches which is equal to approximately 0.1 wavelength (free space).

The mode shifters 74 are mounted only on the top and bottom walls 28 and 30 to compensate for radiation emanating from the side port 48 to inhibit the formation of higher order modes of propagation. No such compensation is required for the radiation of the straight port 46 since such higher order modes have not been observed in the radiation of the straight port 46. Each of the mode shifters 74 is formed as a shim having a thickness of 0.05 inch and a length, as measured along the waveguide axis, of 1.2 inch.

Other dimensions employed in the construction of a preferred embodiment of the launcher 20 are as follows. Each of the vanes 58 and 60 are of negligible thickness, on the order of ten mils, so as to be fully transparent to the vertically-polarized radiation. The front vane 58 measures 1.3 inches and the back vane 60 measures 0.5 inches in the direction of the waveguide axis. The gap between the two vanes 58 and 60 is 0.45 inch. The thickness of the walls of the waveguide 56 is 0.063 inch. The length of the back section 68 is 2.25 inch which corresponds to approximately one free-space wavelength. The length of the front section 66 measures 3.8 inch which is equivalent to approximately 1.7 wavelength. The width of each of the walls of the waveguide 26, at the location of the front flange 38, is 1.6 inches. In the reduced cross-sectional dimensions of the back section 68, the height of the back section 68 is 0.8 inch and the width of the back section 68 is 1.6 inch. The extension H of each of the ridges 50, 52, 54, and 56 from the respective sidewalls towards the central line of the waveguide 26 at the location of the front flange 38 is 0.46 inch. The corresponding width W of each of the ridges is 0.4 inch. The corresponding extension or height of the ridges 50B and 52B in the back section 68 is 0.23 inches corresponding to 0.1 wavelength (free space). The width W of the ridges 50 and 52 is constant throughout the length of the waveguide 26. The width of the ridges 54 and 56 is constant throughout their length in the front section 66. The front edge of the front vane 58 is located 0.4 inch behind the probe 64 of the side port 48, the spacing being equivalent to approximately 0.2 free-space wavelength which, in turn, is equal to one-fourth guide wavelength at this location of the waveguide 26. The inclination of the edges 75 and 78 of the ridge 50 is 5 degrees and 58 minutes from a normal to the top wall 28. The edge 80A of the ridge 50 is inclined by 3 degrees and 26 minutes relative to the top wall 28.

In the construction of the launcher 20 to produce the enlarged bandwidth, it is noted that the four ridges 50, 52, 54, and 56 provide a key role. The cross-sectional dimensions of the four ridges are selected so as to enhance the concentration of the electric fields between the pairs of opposed ridges while, at the same time, permitting substantial transparency to radiations at the opposite polarization. This is accomplished by employing the foregoing cross-sectional dimensions which provide that the width of each of the ridges, as measured at the front flange 38, are equal to one-quarter of the width of a waveguide wall, and protrude from the corresponding waveguide walls to a height equal to almost one-third of the width of a waveguide wall, as measured at the location of the front flange 38. The cross-sectional dimension of the sidewall probe 64 is sufficiently small so as to produce substantial transparency to the vertically polarized radiation of the top-wall probe 62. The angle of inclination of edges of the ridges 50A and 52A to accomplish the flaring of the waveguide 26 are indicated in the drawing. Optimum coupling of electromagnetic energy via the top-wall probe 62 is facilitated by use of the tuning screws 88, the screws being advanced by a selectable distance in accordance with well-known tuning practice.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A launcher of cross-polarized electromagnetic wave comprising:

a first section of waveguide and a second section of waveguide connected thereto;

first probe means in said first waveguide section for launching a first electromagnetic radiation of a first polarization, said first radiation propagating from said first waveguide section into said second waveguide section;

second probe means in said second waveguide section for launching a second electromagnetic radiation of a second polarization orthogonal to said first polarization; and a set of ridges located in orthogonal planes about a central axis of said second section, each of said ridges extending from a wall of said second section and having a face surface facing said central axis, a face surface of a first one of said ridges being normal to an electric field of said first radiation for concentrating said first radiation in front of said first ridge, a face surface of a second one of said ridges being normal to an electric field of said second radiation for concentrating said second radiation in front of said second ridge, said ridges increasing the bandwidth of said launcher, each of said radiations exiting an aperture in a front end of said second waveguide section opposite an end connected to said first waveguide section.

2. A launcher according to claim 1 further comprising blocking means for inhibiting propagation of said second radiation into said first section.

3. A launcher according to claim 1 wherein said first ridge extends within both of said waveguide sections; and wherein said set of ridges includes a third ridge located opposite said first ridge and extending within both said first waveguide section and said second waveguide section; and wherein said set of ridges includes a fourth ridge located opposite said second ridge and extending only in said second waveguide section.

4. A launcher according to claim 3 wherein each of said ridges has a rectangular cross-section, a height of said first ridge and said third ridge being greater at the front end of said second waveguide section than at the back end of said second waveguide section for uniformly concentrating said first radiation in the presence of the flare in said second waveguide section;

the width of each of said ridges at the front end of said second waveguide section is equal to approximately one-fourth of the side of an opening of said waveguide at said front end of said second section; and wherein each of said ridges is of sufficient height to extend a distance of almost one-third of said side of said opening from a wall of said second waveguide section towards said center line.

5. A launcher of cross-polarized electromagnetic waves comprising;

a first section of waveguide and a second section of waveguide, said second section of waveguide being flared from a smaller cross-section at a back end to a larger cross-section at a front end, said back end being connected to said first waveguide section;

first probe means in said first waveguide section for launching a first electromagnetic radiation of a first polarization, said first radiation propagating from said first waveguide section into said second waveguide section;

second probe means in said second waveguide section for launching a second electromagnetic radiation of a second polarization orthogonal to said first polarization; and a set of ridges located in orthogonal planes about a central axis of said second section, each of said ridges extending from a wall of said second section and having a face surface facing said central axis, a face surface of a first one of said ridges being normal to an electric field of said first radiation for concentrating said first radiation in front of said first ridge, a face surface of a second one of said ridges being normal to an electric field of said second radiation for concentrating said second radiation in front of said second ridge, said ridges increasing the bandwidth of said launcher, each of said radiations exiting an aperture in said front end of said second waveguide section.

6. A launcher according to claim 5 wherein said first ridge extends within both of said waveguide sections.

7. A launcher according to claim 6 wherein said second ridge extends only in said second section.

8. A launcher according to claim 7 wherein said second ridge is tapered towards a back end of said second section, said back end of said second section being connected to said first section.

9. A launcher according to claim 8 wherein said set of ridges includes a third ridge located opposite said first ridge and extending within both said first waveguide section and said second waveguide section.

10. A launcher according to claim 9 wherein said set of ridges includes a fourth ridge located opposite said second ridge and extending only in said second waveguide section, said fourth ridge being tapered towards a back end of said second section.

11. A launcher according to claim 10 further comprising blocking means for inhibiting propagation of said second radiation into said first section.

12. A launcher according to claim 11 wherein said blocking means comprises a vane extending transversely across said second waveguide section between said second ridge and said fourth ridge.

13. A launcher according to claim 12 wherein said first waveguide section has a rectangular crosssection, the back end of said second section having a rectangular cross-section and the front end of said second section having a square cross-section.

14. A launcher according to claim 13 wherein each of said ridges has a rectangular cross-section, a height of said first ridge and said third ridge being greater at the front end of said second waveguide section than at the back end of said second waveguide section for uniformly concentrating said first radiation in the presence of the flare in said second waveguide section.

15. A launcher according to claim 14 wherein the width of each of said ridges at the front end of said second waveguide section is equal to approximately one-fourth of the side of an opening of said waveguide at said front end of said second section.

16. A launcher according to claim 15 wherein each of said ridges is of sufficient height to extend a distance of almost one-third of said side of said opening from a wall of said second waveguide section towards said center line.

17. A launcher according to claim 16 wherein a front end of said first section includes an opening for propagation of said first radiation, the back end of said second section includes an opening for propagation of said first radiation, and wherein said front end of said first section and said back end of said second section mate with each other to enable said propagation of said first radiation from said first section to said second section.

18. A launcher according to claim 17 wherein said center line extends from said second section to said first section, and wherein each of said probe means includes probes terminating in radiating elements located on said center line.

19. A launcher according to claim 18 wherein a back end of said first section is an electrically conductive wall serving as a short to said first radiation.

20. A launcher according to claim 19 wherein the terminating radiating element of the probe of said first probe means has the shape of a disk.

21. A launcher according to claim 20 wherein the terminating radiating element of the probe of said second probe means has a shape of a cylinder.

22. A launcher according to claim 21 wherein said terminating radiating element of said second probe means is located less than one-quarter of a guide wavelength from said front end of said second waveguide section, said terminating element of said first probe means being located one-fourth of a guide wavelength behind said front end of said first waveguide section, and wherein said blocking means further comprises a second vane located behind said first mentioned vane, and spaced apart therefrom to prevent generation of circulating currents induced by said second radiation.

23. A launcher of cross-polarized electromagnetic waves comprising:

a first and a second section of waveguides serially connected to each other;

a first and a second probe disposed respectively in said first and said second section of waveguide for launching respectively a first and a second electromagnetic wave of radiation, said first and said second electromagnetic waves being orthogonally polarized, there being a radiating aperture in a front wall of said second waveguide section; and a set of ridges extending inwardly from a boundary of said radiation aperture said ridges being tapered to a reduced height in a direction towards said first waveguide section, each of said waves exiting said aperture.

24. A launcher according to claim 23 further comprising first and second means respectively in said first and said second waveguide sections for directing respectively said first and said second waves towards said apertures.

* * * * *